US011730339B2

(12) United States Patent
Ohayon

(10) Patent No.: US 11,730,339 B2
(45) Date of Patent: Aug. 22, 2023

(54) ARTICLE HOLDER ASSEMBLY FOR A DISHWASHER APPLIANCE

(71) Applicant: Haier US Appliance Solutions, Inc., Wilmington, DE (US)

(72) Inventor: Tal Abraham Ohayon, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 64 days.

(21) Appl. No.: 17/113,967

(22) Filed: Dec. 7, 2020

(65) Prior Publication Data

US 2022/0175217 A1 Jun. 9, 2022

(51) Int. Cl.
*A47L 15/50* (2006.01)

(52) U.S. Cl.
CPC ..... *A47L 15/505* (2013.01); *A47L 15/502* (2013.01); *A47L 15/503* (2013.01)

(58) Field of Classification Search
CPC .. A47L 15/501; A47L 15/503; A47L 15/5053; A47L 19/04; A47L 15/502; A47L 15/505
See application file for complete search history.

(56) References Cited

U.S. PATENT DOCUMENTS 4,589,556 A * 5/1986 Peretz ..... A47L 15/505 211/41.9
6,394,285 B1 * 5/2002 Arthurs ..... A47L 15/505 211/41.9
7,458,471 B2 12/2008 Crudgington, Jr.
10,052,012 B2 8/2018 Mesa et al.
10,159,397 B2 12/2018 Citak et al.
10,368,718 B2 8/2019 Wilson et al.
10,405,731 B2 9/2019 Harr
10,463,226 B2 11/2019 Mesa et al.
2005/0236345 A1 * 10/2005 Herbst ..... A47L 15/505 211/41.9

(Continued)

FOREIGN PATENT DOCUMENTS

CN 105662307 A * 6/2016 ..... A47L 15/505
CN 108095655 A 6/2018

(Continued)

*Primary Examiner* — Joseph L. Perrin
*Assistant Examiner* — Irina Graf
(74) *Attorney, Agent, or Firm* — Dority & Manning, P.A.

(57) ABSTRACT

An article holder assembly for use with a dishwasher appliance includes a base portion adapted to fit onto an upper rack or a lower rack of the dishwasher appliance. The article holder assembly includes at least one arm member removably coupled to the base portion, a first attachment location for the at least one arm member, and a second attachment location for the at least one arm member. Further, the article holder assembly is adjustable between an engaged position and a disengaged position. Thus, in the engaged position, the arm member(s) is secured to the first attachment location such that the arm member(s) extends outward from the base portion to support one or more of the articles during a wash cycle of the dishwasher appliance. Moreover, in the disengaged position, the arm member(s) is secured to the second attachment location such that the arm member(s) rests against the base portion.

19 Claims, 6 Drawing Sheets

(56) References Cited

U.S. PATENT DOCUMENTS

| | | | | |
|---|---|---|---|---|
| 2005/0268945 | A1* | 12/2005 | Hedstrom | A47L 15/503 134/135 |
| 2006/0138064 | A1* | 6/2006 | Crudgington | A47L 15/505 211/41.9 |
| 2008/0083678 | A1* | 4/2008 | Graute | A47L 15/505 211/41.8 |
| 2012/0211453 | A1* | 8/2012 | Stegerwald | D06F 58/04 211/85.3 |
| 2012/0292273 | A1* | 11/2012 | McNamara | A47L 15/503 211/79 |
| 2014/0132136 | A1* | 5/2014 | Kilic | A47L 15/503 312/228.1 |
| 2018/0116485 | A1* | 5/2018 | Wegner | A47L 19/04 |
| 2018/0168427 | A1* | 6/2018 | Wilson | A47L 15/505 |
| 2020/0281441 | A1* | 9/2020 | Kim | A47L 15/505 |

FOREIGN PATENT DOCUMENTS

| | | | | | |
|---|---|---|---|---|---|
| CN | 110101347 | A | | 8/2019 | |
| CN | 105534462 | B | | 12/2019 | |
| CN | 110881920 | A | | 3/2020 | |
| DE | 10106763 | A1 | | 8/2002 | |
| DE | 102014207448 | A1 | * | 10/2015 | A47L 15/505 |
| EP | 1683465 | B1 | * | 9/2009 | A47L 15/503 |
| EP | 1929928 | B1 | | 2/2012 | |
| EP | 2798996 | B1 | | 8/2015 | |
| EP | 3127464 | A1 | * | 2/2017 | A47L 15/503 |
| EP | 3266362 | A1 | * | 1/2018 | A47L 15/503 |
| EP | 3164045 | B1 | | 8/2018 | |
| FR | 2649081 | A | * | 1/1991 | A47L 15/505 |
| GB | 1393054 | A | | 5/1975 | |
| WO | WO2013/045543 | A1 | | 4/2013 | |
| WO | WO-2016034201 | A1 | * | 3/2016 | A47L 15/503 |
| WO | WO-2016192792 | A1 | * | 12/2016 | A47L 15/505 |

* cited by examiner

ARTICLE HOLDER ASSEMBLY FOR A DISHWASHER APPLIANCE

FIELD OF THE INVENTION

The present subject matter relates generally to dishwasher appliances and, in particular, to a removable article holder assembly for a dishwasher appliance.

BACKGROUND OF THE INVENTION

Dishwasher appliances generally include a tub that defines a wash chamber. Dishwasher appliances also generally include a rack assembly mounted within the wash chamber. The rack assembly is configured for receipt of articles for washing. For example, a user can slide the rack assembly out of the wash chamber and load plates, bowls, cups, or any suitable article or combination of articles into the rack assembly. After loading is complete, the user may slide the rack assembly back into the wash chamber.

In particular, the user can slide the rack assembly is to a retracted position. During operation of the dishwasher appliance, such a configuration for the rack assembly is preferable and may be required for certain dishwasher appliance components to function properly. Further, certain dishwasher appliances include a spray assembly mounted to the rack assembly. The spray assembly is normally configured such that the rack assembly must be positioned in the retracted position for the spray assembly to receive wash fluid during operation of the dishwasher appliance. The rack assembly may include, for example, top and bottom racks or top, middle, and bottom racks.

In certain dishwasher appliances, the top rack assembly may include a stemware holder on either side thereof. However, the top rack places stringent height restrictions on stemware placed therein. Furthermore, with the addition of a middle rack, such height restrictions are even more stringent.

Accordingly, a stemware holder assembly that addresses the aforementioned issues would be useful. Thus, the present disclosure is directed to a removable article holder assembly for use in any of the racks in the dishwasher appliance.

BRIEF DESCRIPTION OF THE INVENTION

Aspects and advantages of the invention will be set forth in part in the following description, or may be obvious from the description, or may be learned through practice of the invention.

In an aspect, the present disclosure is directed to a dishwasher appliance having a tub that defines a wash chamber. The dishwasher appliance also includes a door mounted proximate the tub and permitting selective access to the wash chamber of the tub. Further, the dishwasher appliance includes a rack assembly mounted within the wash chamber and configured for receipt of articles for cleaning. The rack assembly includes an upper rack and a lower rack. Moreover, the dishwasher appliance includes a removable article holder assembly having a base portion and at least one arm member removably coupled to the base portion. The base portion is adapted to fit onto at least one of the upper rack or the lower rack. Further, the article holder assembly is adjustable between an engaged position and a disengaged position. Thus, in the engaged position, the arm member(s) is secured to a first attachment location such that the arm member(s) extends outward from the base portion to support one or more of the articles during a wash cycle of the dishwasher appliance. In addition, in the disengaged position, the arm member(s) is secured to a second attachment location such that the arm member(s) rests against the base portion.

In another aspect, the present disclosure is directed to an article holder assembly. The article holder assembly includes a base portion. Further, the article holder assembly includes at least one arm member removably coupled to the base portion, a first attachment location for the at least one arm member, and a second attachment location for the arm member(s). Further, the article holder assembly is adjustable between an engaged position and a disengaged position. Thus, in the engaged position, the arm member(s) is secured to the first attachment location such that the arm member(s) extends outward from the base portion to support one or more articles. Moreover, in the disengaged position, the arm member(s) is secured to the second attachment location such that the arm member(s) rests against the base portion.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
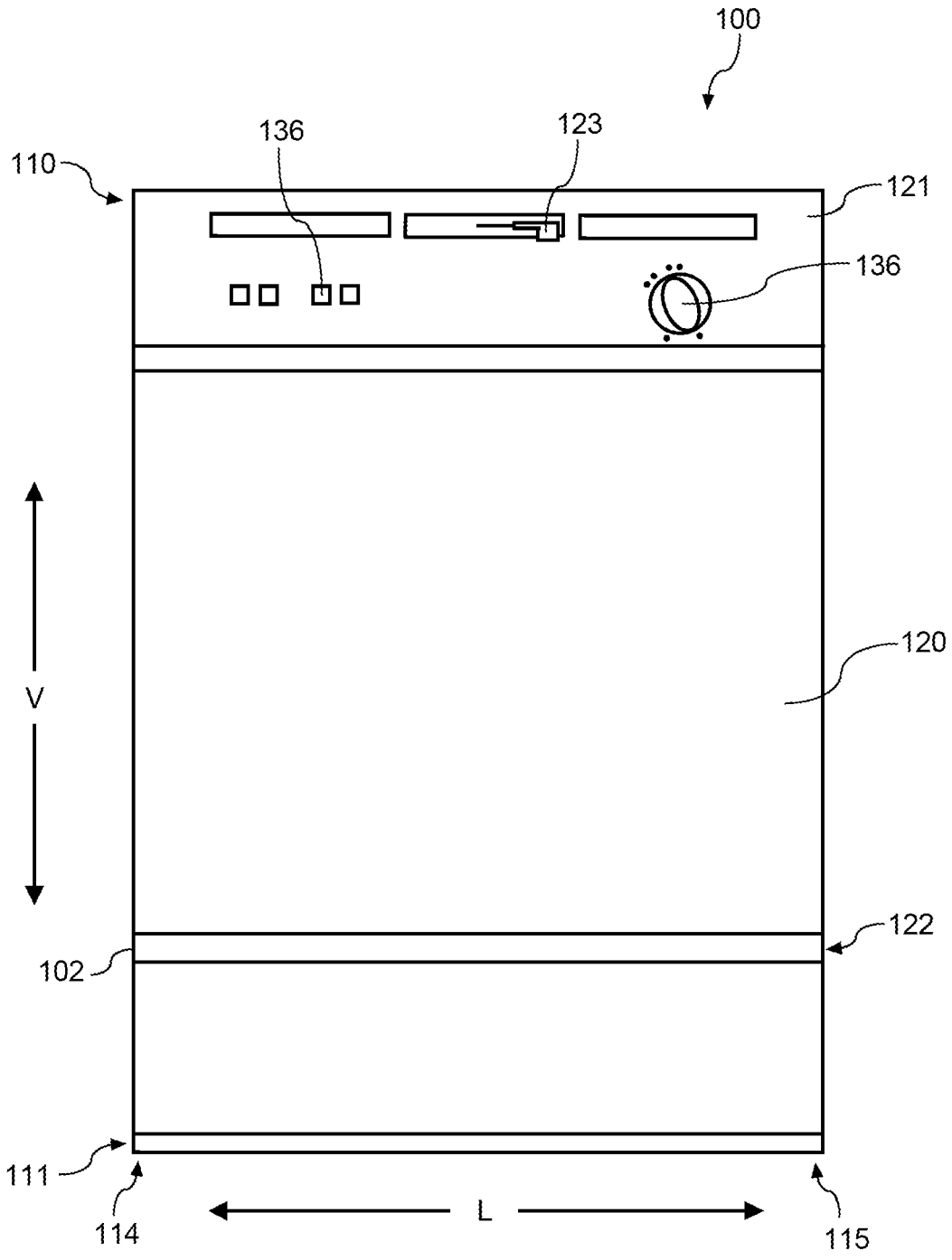
FIG. 1 provides a front view of a dishwasher appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
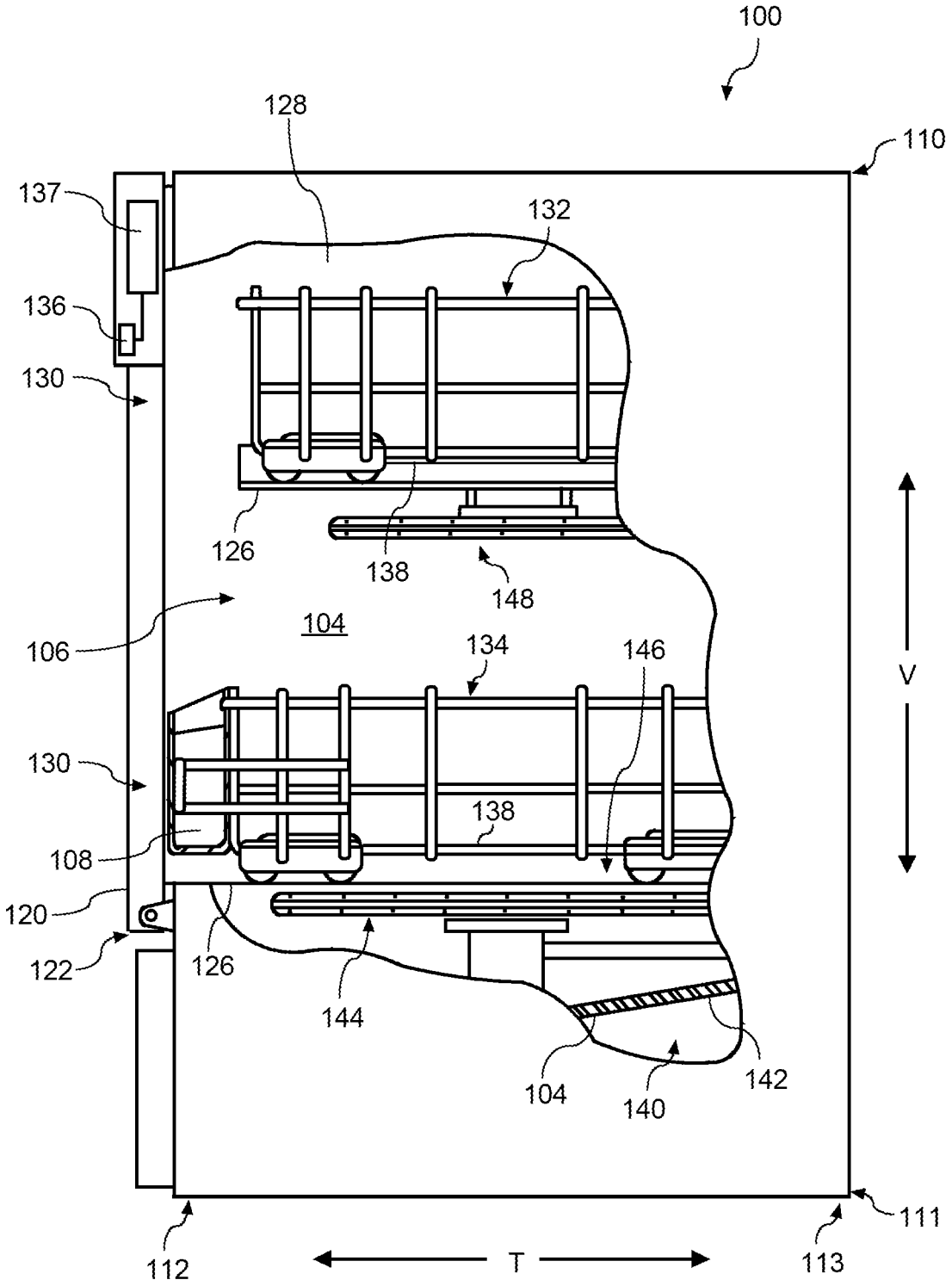
FIG. 2 provides a side view of the dishwasher appliance of FIG. 1 with portions of a cabinet of the dishwasher appliance removed to reveal an interior of the dishwasher appliance.

Referring now to the drawings, FIGS. 1 and 2 depict an exemplary dishwasher appliance 100 that may be configured in accordance with aspects of the present disclosure. The dishwasher appliance 100 includes a cabinet 102 having a tub 104 (FIG. 2) therein that defines a wash chamber 106 (FIG. 2). The tub 104 includes a door 120 hinged at its bottom 122 for movement between a normally closed configuration that is shown in FIGS. 1 and 2, wherein the wash chamber 106 is sealed shut, e.g., during dishwasher appliance 100 operation, and an open configuration, e.g., for loading and unloading of articles from the dishwasher appliance 100. A latch 123 (FIG. 1) is used to lock and unlock the door 120 for access to wash chamber 106.

Dishwasher appliance 100 defines a vertical direction V, a lateral direction L, and a transverse direction T. As may be seen in FIG. 1, dishwasher appliance 100 extends between a top 110 and a bottom 111 along the vertical direction V and also extend between a first side 114 and a second side 115 along the lateral direction L. As may be seen in FIG. 2, dishwasher appliance 100 also extends between a front 112 and a back 113 along the transverse direction T. Vertical direction V, lateral direction L, and transverse direction T are mutually perpendicular and form an orthogonal directional system.

As shown in FIG. 2, guide rails 126 are mounted on tub sidewalls 128 and accommodate a rack assembly 130, e.g. having upper and lower roller-equipped racks 132, 134. Each of the upper and lower racks 132, 134 is fabricated from lattice structures that include a plurality of elongated members 138. Each rack 132, 134 is adapted for movement between an extended loading position (not shown) in which the rack is substantially positioned outside the wash chamber 106, and a retracted position (shown in FIGS. 1 and 2) in which the rack is located inside the wash chamber 106.

As shown particularly in FIG. 2, a silverware basket 108 may be removably mounted to the lower rack 134. However, the silverware basket 108 may also be selectively attached to other portions of dishwasher appliance 100, e.g., the upper rack 132 or the door 120. Thus, the silverware basket 108 is configured for receipt of silverware, utensils, and the like (e.g., spoons, forks, and/or knives) that are too small to be accommodated by the upper and lower racks 132, 134. Further, the silverware basket 108 may be constructed of any suitable material, e.g., metal or plastic, and is discussed in greater detail below.

The dishwasher appliance 100 further includes a lower spray assembly 144 that is mounted within a lower region 146 of the wash chamber 106 and above a tub sump portion 142 so as to be positioned in relatively close proximity to lower rack 134. A mid-level spray assembly 148 is located in an upper region of the wash chamber 106 and may be located in close proximity to upper rack 132. In particular, mid-level spray assembly 148 may be mounted to upper rack 132 as discussed in greater detail below.

The spray assemblies 144, 148 are fed by a fluid circulation assembly (not shown) for circulating water and wash fluid in the tub 104. Portions of the fluid circulation assembly may be located in a machinery compartment 140 located below the bottom sump portion 142 of the tub 104, as generally recognized in the art. Each spray assembly includes an arrangement of discharge ports or orifices for directing washing liquid onto dishes or other articles located in the rack assembly 130 and the silverware basket 108. The arrangement of the discharge ports in at least the lower spray assembly 144 provides a rotational force by virtue of washing fluid flowing through the discharge ports. The resultant rotation of the lower spray assembly 144 provides coverage of dishes and other dishwasher contents with a washing spray.

The dishwasher appliance 100 is further equipped with a controller 137 to regulate operation of the dishwasher appliance 100. The controller 137 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one exemplary embodiment, the processor executes programming instructions stored in memory. The memory may be a separate component from the processor or may be included onboard within the processor.

The controller 137 may be positioned in a variety of locations throughout dishwasher appliance 100. In the illustrated exemplary embodiment, the controller 137 may be located within a control panel area 121 of door 120 as shown. In such an embodiment, input/output ("I/O") signals may be routed between the control system and various operational components of dishwasher appliance 100 along wiring harnesses that may be routed through the bottom 122 of door 120. Typically, the controller 137 includes a user interface panel 136 through which a user may select various operational features and modes and monitor progress of the dishwasher appliance 100. In one exemplary embodiment, the user interface panel 136 may represent a general purpose I/O ("GPIO") device or functional block. In one exemplary embodiment, the user interface panel 136 may include input components, such as one or more of a variety of electrical, mechanical or electro-mechanical input devices including rotary dials, push buttons, and touch pads. The user interface panel 136 may include a display component, such as a digital or analog display device designed to provide operational feedback to a user. The user interface 136 may be in communication with the controller 137 via one or more signal lines or shared communication busses.

It should be appreciated that the present subject matter is not limited to any particular style, model, or other configuration of dishwasher appliance and that the exemplary embodiment depicted in FIGS. 1 and 2 is for illustrative purposes only. For example, the present subject matter may be used in dishwasher appliances having other rack configurations.

Figure 3:
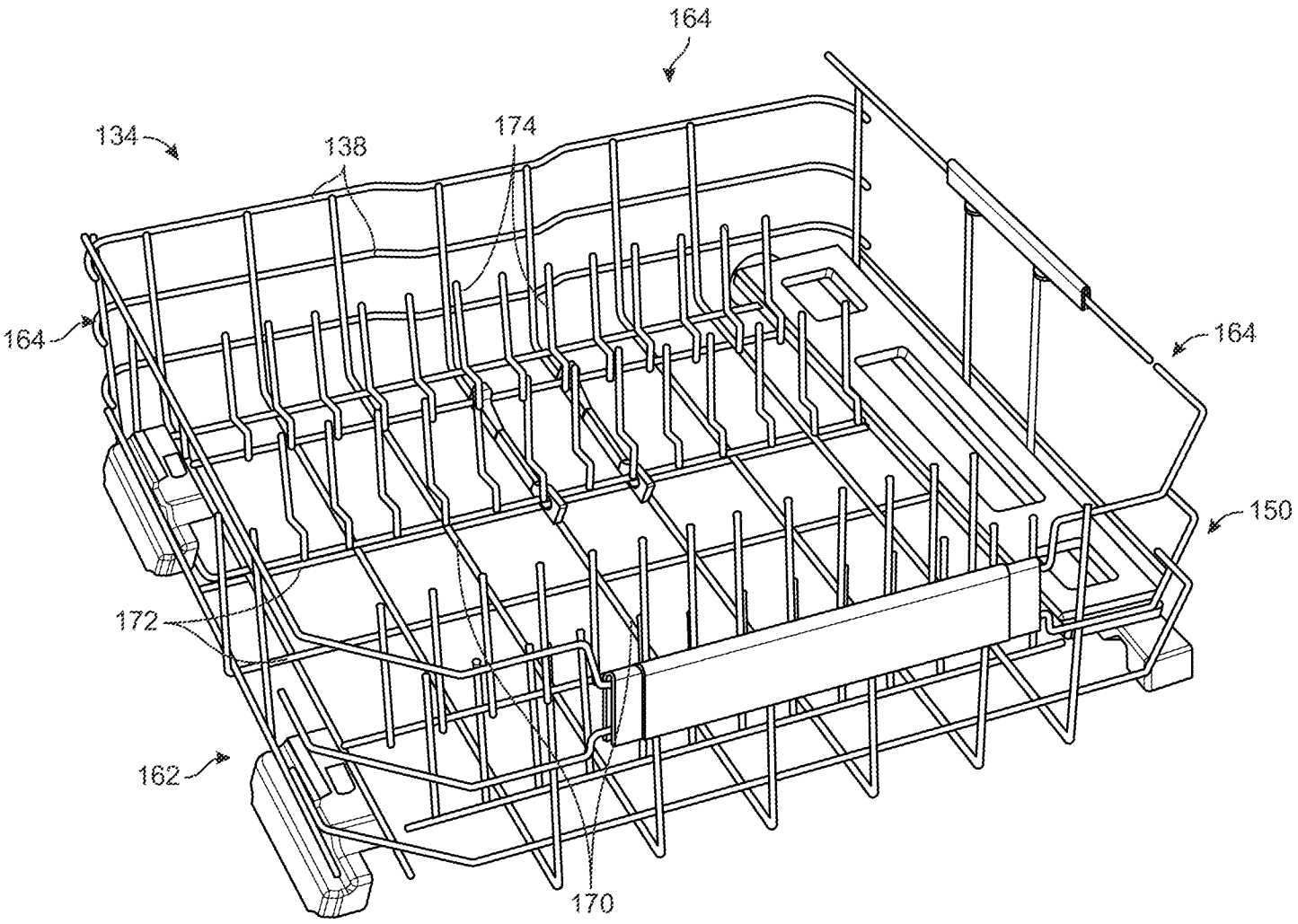
FIG. 3 illustrates a perspective view of a rack of a dishwasher appliance according to an exemplary embodiment of the present subject matter.

Referring now to FIG. 3, a perspective view of a rack of the rack assembly according to the present disclosure is illustrated. It should be understood that the lower rack 134 and the upper rack 132 may be configured similar to each other, therefore, only one of the racks is illustrated, but can be representative of both. Thus, as shown, the rack(s) 132, 134 is generally configured as a basket-like structure having a bottom wall 162 and a front wall 150 and sidewalls 164 that extends upwardly from the bottom wall 162 along the vertical direction V. Further, as shown, the front wall 150 extends along the lateral direction L in order to extend between and connect the sidewalls 164. The front wall 150 and sidewalls 164 form corners 190 where front wall 150 meets the sidewalls 164.

As discussed above, the rack(s) 132, 134 is formed from plurality of elongated members 138. Thus, bottom wall 162, front wall 150, and sidewalls 164 may be formed with wire or rod members into an open lattice structure. For example, the bottom wall 162 may be defined by a plurality of longitudinal rods 172 that are crossed with a plurality of lateral rods 170, as generally known in the art. Rods 170, 172 may be connected together by any suitable means, including welding, epoxy, clips, and so forth. Further, as shown, a plurality of fixed tines 174 project vertically upward from bottom wall 162 and from any combination of the rods 170, 172. Accordingly, the rack(s) 132, 134 is configured for receiving articles for cleaning.

Referring now to FIGS. 4-8, various views of an article holder assembly 200 according to the present disclosure, e.g. that can be used in the dishwasher appliance 100, is illustrated. Thus, it should be understood that the article holder assembly 200 described herein can be used with any suitable dishwasher appliance as well as any other application, such as, for example, storage for articles on a wall, on a counter, in a pantry, etc.

More specifically, as shown, the article holder assembly 200 has a base portion 202 and at least one arm member 204, 206 removably coupled to the base portion 202. For example, as shown generally in FIGS. 4-8, the article holder assembly 200 may include a plurality of arm members 204, 206, such as a first arm member 204 and a second arm member 206. Moreover, as shown, the article holder assembly 200 may include at least one first attachment location 214 and at least one second attachment location 216. More specifically, as shown in the illustrated embodiment, the base portion 202 of the removable article holder assembly 200 may include opposing first attachment locations 214 (i.e. one on each side of the base portion 202) as well as opposing second attachment locations 216 (i.e. one on each side of the base portion 202).

Figure 4:
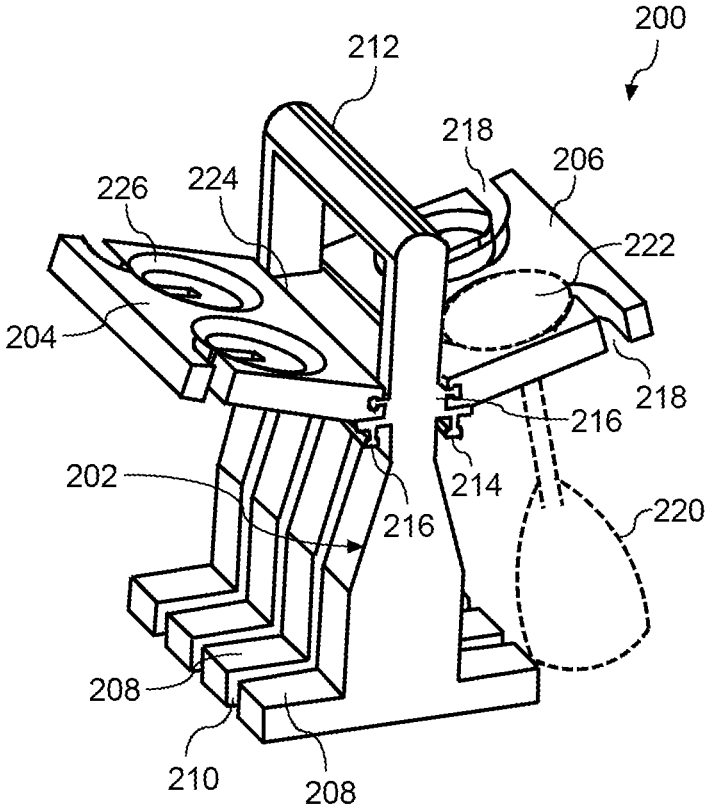
FIG. 4 illustrates a perspective view of a removable article holder assembly according to an exemplary embodiment of the present subject matter, particularly illustrating the article holder assembly in an engaged position.
Figure 5:
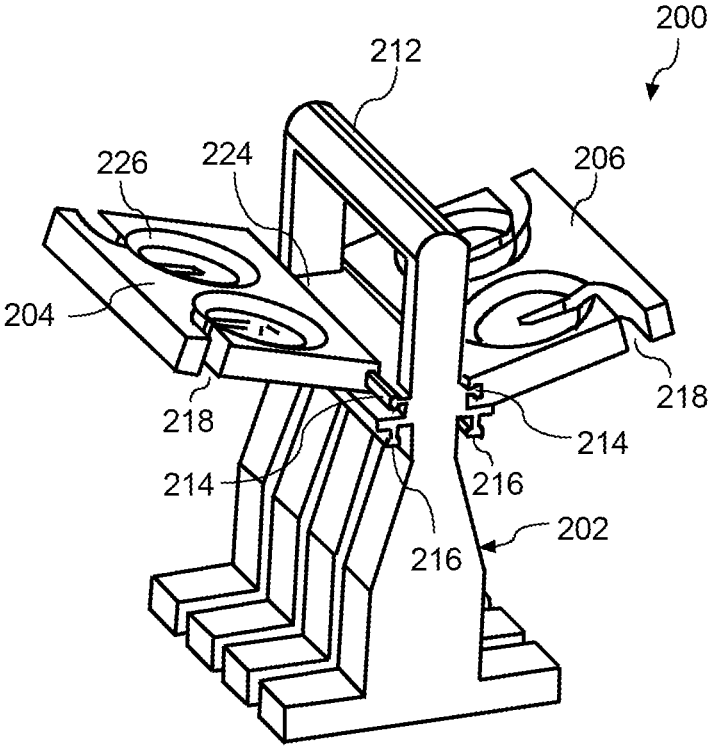
FIG. 5 illustrates another perspective view of a removable article holder assembly according to an exemplary embodiment of the present subject matter, particularly illustrating the article holder assembly being slid into an engaged position.
Figure 6:
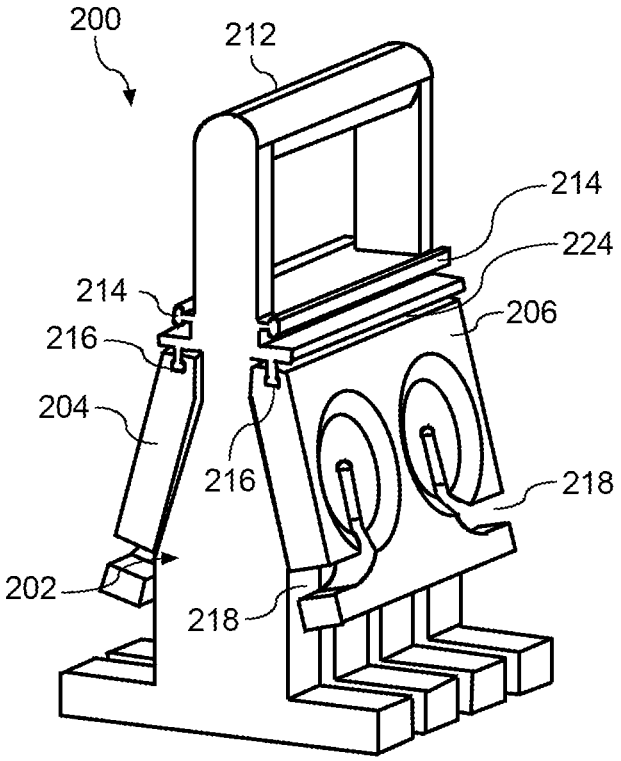
FIG. 6 illustrates a perspective view of a removable article holder assembly according to an exemplary embodiment of the present subject matter, particularly illustrating the article holder assembly in a disengaged position.
Figure 7:
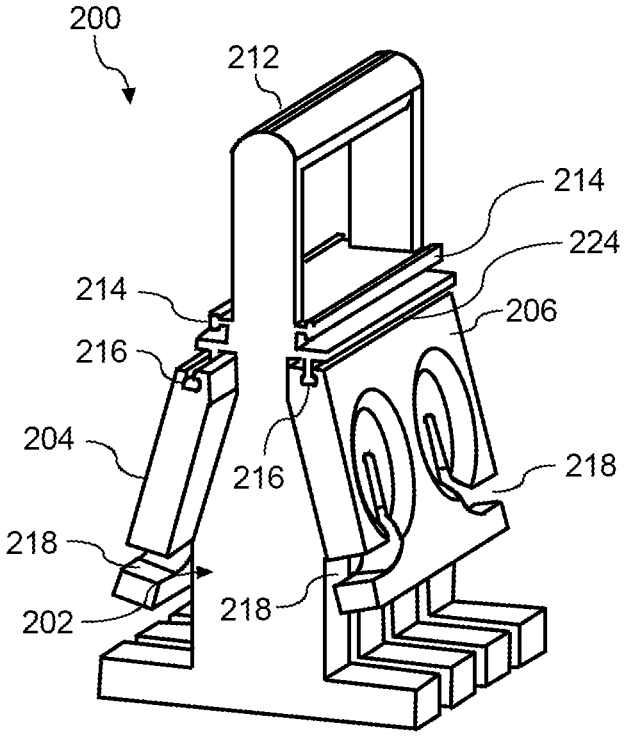
FIG. 7 illustrates another perspective view of a removable article holder assembly according to an exemplary embodiment of the present subject matter, particularly illustrating the article holder assembly being slid into a disengaged position.
Figure 8:
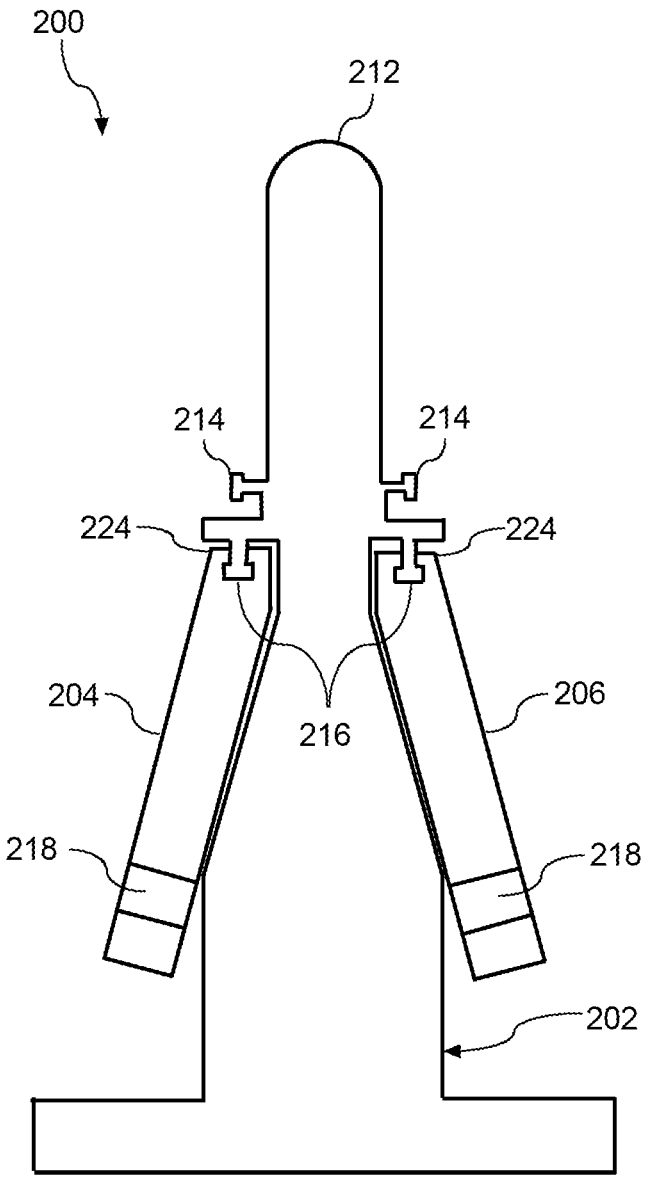
FIG. 8 illustrates a side view of a removable article holder assembly according to an exemplary embodiment of the present subject matter.

Accordingly, the article holder assembly 200 is adjustable between an engaged position (FIGS. 4 and 5) and a disengaged position (FIGS. 6-8). In particular, as shown in FIGS. 4 and 5, in the engaged position, the first and second arm members 204, 206 can be secured to the opposing first attachment locations 214, respectively, such that the arm members 204, 206 extend outward from the base portion 202 to support one or more of the articles during a wash cycle of the dishwasher appliance 100. In addition, as shown in FIGS. 6-8, in the disengaged position, the arm members 204, 206 may be secured to the opposing second attachment locations 216, respectively, such that the arm members 204, 206 rest against the base portion 202.

In further embodiments, as shown particularly in FIGS. 4 and 5, edges 224 of the first and second arm members 204, 206 and the opposing first attachment locations 214 may have corresponding dovetail connections. Similarly, as shown in FIGS. 6-8, the edges 224 of the first and second arm members 204, 206 and the opposing second attachment locations 216 may also have corresponding dovetail connections. Thus, as shown, for example, in FIGS. 5 and 7, the edges 224 of the first and second arm members 204, 206 are slidable with respect to the first and second attachment locations 214, 216. Accordingly, the first and second arm members 204, 206 can be easily moved between the engaged and disengaged positions, as well as removed from the base portion 202 completely (e.g. to exchange with another type of arm member). In certain embodiments, as shown in FIG. 8, the dovetail connections may have a T-shaped configuration.

In particular embodiments, as shown, the base portion 202 is adapted to fit onto at least one of the upper rack 132 or the lower rack 134 of the dishwasher appliance 100. More specifically, as shown in FIGS. 4-7, the base portion 202 of the removable article holder assembly 200 may include at least one flange 208 or foot for placing adjacent to at least one tine 174 (FIG. 3) in any of the racks of the dishwasher appliance 100. For example, as shown, the base portion 202 may include a plurality of flanges 208, with each flange 208 being spaced apart by a certain distance 210 such that the flanges 208 of the base portion 202 fit between the tines 174 in one of the upper rack 132 or the lower rack 134 of the rack assembly 130 of the dishwasher appliance 100.

Thus, in such embodiments, the article holder assembly 200 can fit at any suitable location in the dishwasher appliance 100 due the flange(s) 208 being able to fit between tine spacing in the various racks of the dishwasher appliance 100. In addition, in particular embodiments, the article holder assembly 200 may also be placed over the silverware blaster manifold or anywhere else in the lower rack 134. Moreover, as shown, the base portion 202 of the removable article holder assembly 200 may also include a handle 212. Thus, in such embodiments, the removable article holder assembly 200 can be easily moved within the dishwasher appliance 100 to a desired location and/or easily removed out of the dishwasher appliance 100.

It should be understood that the first and second arm members 204, 206 can be designed to accommodate multiple types of articles, such as, for example, stemware, water bottles, and/or any other types of articles having a unique configuration that is difficult to clean effectively in the rack assembly 130. Further, as shown in FIGS. 3 and 4, when the first and second arm members 204, 206 secured to the opposing first attachment locations 214 are in the engaged position, the first and second arm members 204, 206 extend slightly upward at an angle (e.g. with respect to the horizontal direction) such that fluid does not pool atop one or more of the articles during operation of the dishwasher appliance 100.

In particular, as shown in the illustrated embodiment, the first and second arm members 204, 206 may be unique designed to accommodate stemware. Thus, referring generally in FIGS. 4-8, each of the arm members 204, 206 may also include at least one slot 218 for receiving a stem 220 of stemware. Thus, as shown particularly in FIG. 4, when the stem 220 is received within the slot 218, the arm member(s) 204, 206 supports a base 222 of the stemware therein. Moreover, as shown, the arm member(s) 204, 206 may also have a recess 226 for receiving the base 222 of the stemware therein to further hold the stemware in place during washing. In addition, as shown particularly in FIG. 4, the slot(s) 218 may define an arcuate path that prevents the stem 220 of stemware from dislodging therefrom during the wash cycle of the dishwasher appliance 100. In still further embodiments, the arm member(s) 204, 206 can be designed with any other features for accommodating any other articles as well.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher appliance, comprising:

a tub defining a wash chamber;

a door mounted proximate the tub and permitting selective access to the wash chamber of the tub;

a rack assembly mounted within the wash chamber and configured for receipt of articles for cleaning, the rack assembly comprising an upper rack and a lower rack; and a removable article holder assembly comprising a base portion and at least one arm member removably coupled to the base portion, the base portion adapted to fit onto at least one of the upper rack or the lower rack, wherein the at least one arm member comprises at least one slot for receiving a stem of stemware and at least one recess formed into the at least one arm member to define an indentation on an upper surface of the at least one arm member, the indentation defining a shape corresponding to a base of the stemware, the at least one slot extending from a first end at an exterior surface of the at least one arm member outside of the at least one recess to a second end at a location within the at least one recess, the second end defining a stop within the at least one recess, wherein the stem of the stemware is slidable from the first end of the at least one slot and through the at least one slot up to the stop at the second end such that, once the stem of the stemware reaches the stop, the base of the stemware sits within the at least one recess, wherein the article holder assembly is adjustable between an engaged position and a disengaged position, wherein, in the engaged position, the at least one arm member is secured to a first attachment location such that the at least one arm member extends outward from the base portion to support the stemware during a wash cycle of the dishwasher appliance, and wherein, in the disengaged position, the at least one arm member is secured to a second attachment location such that the at least one arm member rests against the base portion.

2. The dishwasher appliance of claim 1, wherein the base portion of the removable article holder assembly further comprises a handle.

3. The dishwasher appliance of claim 1, wherein the base portion of the removable article holder assembly further comprises at least one flange for placing adjacent to at least one tine in one of the upper rack or the lower rack of the rack assembly of the dishwasher appliance.

4. The dishwasher appliance of claim 3, wherein the base portion of the removable article holder assembly further comprises a plurality of flanges, each of the plurality of flanges being spaced apart by a certain distance such that the base portion fits between a plurality of tines in one of the upper rack or the lower rack of the rack assembly of the dishwasher appliance.

5. The dishwasher appliance of claim 1, wherein the at least one slot defines an arcuate path that prevents the stem of stemware from dislodging therefrom during the wash cycle of the dishwasher appliance.

6. The dishwasher appliance of claim 1, wherein, when the at least one arm member is secured to the first attachment location in the engaged position, the at least one arm member extends at an angle such that fluid does not pool atop the base of the stemware during operation of the dishwasher appliance.

7. The dishwasher appliance of claim 1, wherein the removable article holder assembly further comprises a plurality of arm members, the at least one arm member being a first arm member of the plurality of arm members, the plurality of arm members comprising, at least, the first arm member and a second arm member.

8. The dishwasher appliance of claim 7, wherein the base portion of the removable article holder assembly further comprises opposing first attachment locations such that, in the engaged position, the first and second arm members are secured to the opposing first attachment locations, respectively, and wherein the first and second arm members extend outward from the base portion to support the stemware during the wash cycle of the dishwasher appliance.

9. The dishwasher appliance of claim 8, wherein edges of the first and second arm members and the opposing first attachment locations comprise corresponding dovetail connections.

10. The dishwasher appliance of claim 9, wherein the base portion of the removable article holder assembly further comprises opposing second attachment locations such that, in the disengaged position, the first and second arm members are secured to the opposing second attachment locations, respectively, and wherein the first and second arm members rest against opposing sides of the base portion.

11. The dishwasher appliance of claim 10, wherein the edges of the first and second arm members and the opposing second attachment locations comprise corresponding dovetail connections.

12. The dishwasher appliance of claim 11, wherein the edges of the first and second arm members are slidable with respect to the first and second attachment locations.

13. The dishwasher appliance of claim 11, wherein the dovetail connections comprise a T-shaped configuration.

14. An article holder assembly, comprising:

a base portion;

at least one arm member removably coupled to the base portion, wherein the at least one arm member comprises at least one slot for receiving a stem of stemware and at least one recess formed into the at least one arm member to define an indentation on an upper surface of the at least one arm member, the indentation defining a shape corresponding to a base of the stemware, the at least one slot extending from a first end at an exterior surface of the at least one arm member outside of the at least one recess to a second end at a location within the at least one recess, the second end defining a stop within the at least one recess, wherein the stem of the stemware is slidable from the first end of the at least one slot and through the at least one slot up to the stop at the second end such that, once the stem of the stemware reaches the stop, the base of the stemware sits within the at least one recess;

a first attachment location for the at least one arm member; and a second attachment location for the at least one arm member;

wherein the article holder assembly is adjustable between an engaged position and a disengaged position, wherein, in the engaged position, the at least one arm member is secured to the first attachment location such that the at least one arm member extends outward from the base portion to support one or more stemware, and wherein, in the disengaged position, the at least one arm member is secured to the second attachment location such that the at least one arm member rests against the base portion.

15. The article holder assembly of claim 14, wherein the base portion further comprises a handle above the first and second attachment locations.

16. The article holder assembly of claim 14, wherein the base portion further comprises a plurality of flanges, each of the plurality of flanges being spaced apart by a certain distance such that the base portion fits between a plurality of tines in one of an upper rack or a lower rack of a dishwasher appliance.

17. The article holder assembly of claim 14, wherein the at least one slot defines an arcuate path that prevents the stem of stemware from dislodging therefrom.

18. The article holder assembly of claim 14, further comprising a plurality of arm members, the at least one arm member being a first arm member of the plurality of arm members, the plurality of arm members comprising, at least, the first arm member and a second arm member, wherein the base portion further comprises:

opposing first attachment locations such that, in the engaged position, the first and second arm members are secured to the opposing first attachment locations, respectively, and wherein the first and second arm members extend outward from the base portion to support the stemware, and opposing second attachment locations such that, in the disengaged position, the first and second arm members are secured to the opposing second attachment locations, respectively, and wherein the first and second arm members rest against opposing sides of the base portion.

19. The article holder assembly of claim 18, wherein edges of the first and second arm members, the opposing first attachment locations, and the opposing second attachment locations comprise corresponding dovetail connections, and wherein the edges of the first and second arm members are slidable with respect to the first and second attachment locations.

* * * * *